US008303253B1

(12) United States Patent
Liang

(10) Patent No.: US 8,303,253 B1
(45) Date of Patent: Nov. 6, 2012

(54) TURBINE AIRFOIL WITH NEAR-WALL MINI SERPENTINE COOLING CHANNELS

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 867 days.

(21) Appl. No.: 12/357,443

(22) Filed: Jan. 22, 2009

(51) Int. Cl.
*F01D 5/18* (2006.01)
*F01D 5/08* (2006.01)
*F01D 5/20* (2006.01)

(52) U.S. Cl. ..... 416/97 R; 416/95; 416/96 A; 416/97 A; 415/115

(58) Field of Classification Search ..... None
See application file for complete search history.

(56) References Cited

U.S. PATENT DOCUMENTS 5,468,125 A * 11/1995 Okpara et al. ..... 416/97 R
5,626,462 A * 5/1997 Jackson et al. ..... 416/97 R
6,254,334 B1 * 7/2001 LaFleur ..... 415/115
6,602,053 B2 * 8/2003 Subramanian et al. ..... 416/97 R

* cited by examiner

*Primary Examiner* — Julio J Maldonado
*Assistant Examiner* — Shantanu C Pathak
(74) *Attorney, Agent, or Firm* — John Ryznic

(57) ABSTRACT

A turbine airfoil includes a plurality of mini serpentine flow passages to provide near wall cooling to a thin thermal skin that forms the outer airfoil surface. The airfoil includes a spar with a number spanwise extending external ribs with a series of mini pin fins extending between adjacent ribs. The thin skin includes an arrangement of mini pin fins that, when bonded to the spar, form the serpentine flow passages. The thin thermal skin is bonded to the spar to form the airfoil. The mini serpentine flow passages can be formed in the airfoil walls with a small size that cannot be formed in an airfoil formed by the investment casting process. With the use of a thin thermal skin, higher levels of cooling can be produced using the near wall cooling process.

11 Claims, 3 Drawing Sheets

TURBINE AIRFOIL WITH NEAR-WALL MINI SERPENTINE COOLING CHANNELS

FEDERAL RESEARCH STATEMENT

None.

CROSS-REFERENCE TO RELATED APPLICATIONS

None.

BACKGROUND OF THE INVENTION

1. Field of the Invention

The present invention relates generally to a gas turbine engine, and more specifically to a turbine airfoil with near wall cooling.

2. Description of the Related Art Including Information Disclosed Under 37 CFR 1.97 and 1.98

A gas turbine engine, such as an industrial gas turbine (IGT) engine, includes a turbine with a number of stages or rows of turbine stator vanes and rotor blades that react with a hot gas flow. These vanes and blades both include an airfoil portion that is exposed to the hot gas flow. In order to allow for higher temperatures, these airfoils include internal cooling circuits to limit thermal damage to the high gas flow temperature.

Turbine airfoils are typically cast from a ceramic core using the well known investment casting process. However, of the investment casting process has limits as to the size of cooling passages or the shape of cooling channels. Also, thin near wall cooled airfoil surfaces cannot be cast using the investment casting process because the airfoil wall is too thin for casting. The molten liquid metal will not flow through a space formed within the mold that is too thin. Also, small features such as small impingement holes or trip strips cannot be formed using this process because the ceramic core used to form these passages would be much too brittle and small so that the ceramic pieces would break when the heavy and viscous molten metal strikes the pieces.

One prior art cooling design for a turbine airfoil is shown in FIG. 1 and includes an airfoil main body a number of radial channels with re-supply holes in conjunction with film cooling holes. The cooling air is supplied from the fire tree root to the individual radial flow channels and then discharged into the collector cavity formed between the pressure side and suction side walls. The spent cooling air in the collection cavity then flows through the metering holes and into the leading edge impingement cavity to provide impingement cooling for the back side wall of the leading edge. The spent impingement cooling air then flows through the film cooling holes and gill holes as film cooling air for the leading edge surface of the airfoil. With this design, the spanwise and chordwise cooling flow control due to the airfoil external hot gas temperature and pressure variation is difficult to achieve. In addition, single radial channel flow is not the best method of utilizing cooling air and therefore results in a low convective cooling effectiveness.

BRIEF SUMMARY OF THE INVENTION

It is an object of the present invention to provide, for a turbine airfoil with a thin thermal skin construction and with near wall cooling.

It is another object of the present invention to provide for a turbine airfoil with a near wall serpentine flow channel that cannot be formed from the investment casting process.

A turbine airfoil, such as a stator vane or a rotor blade, with a spar forming the airfoil shape with the internal cooling air collection cavities in which the outer surface includes radial extending ribs and chordwise extending mini pin fins extending outward and in-between the radial ribs for form part of the serpentine flow passages. A thin thermal skin forms the outer airfoil surface and includes mini pin fins extending from the backside and at alternating locations to the pin fins on the spar. The thin skin is bonded to the spar to form the outer airfoil surface and the radial extending mini serpentine flow passages.

DETAILED DESCRIPTION OF THE INVENTION

Figure 1:
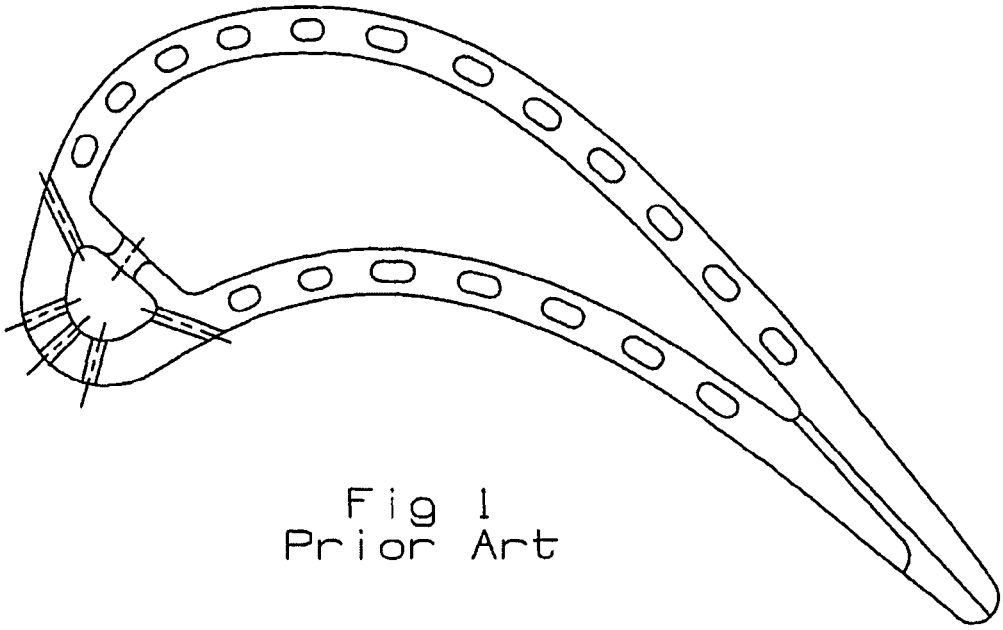
Fig 1 Prior Art
FIG. 1 shows a prior art turbine airfoil with radial extending passages for airfoil wall cooling.
Figure 2:
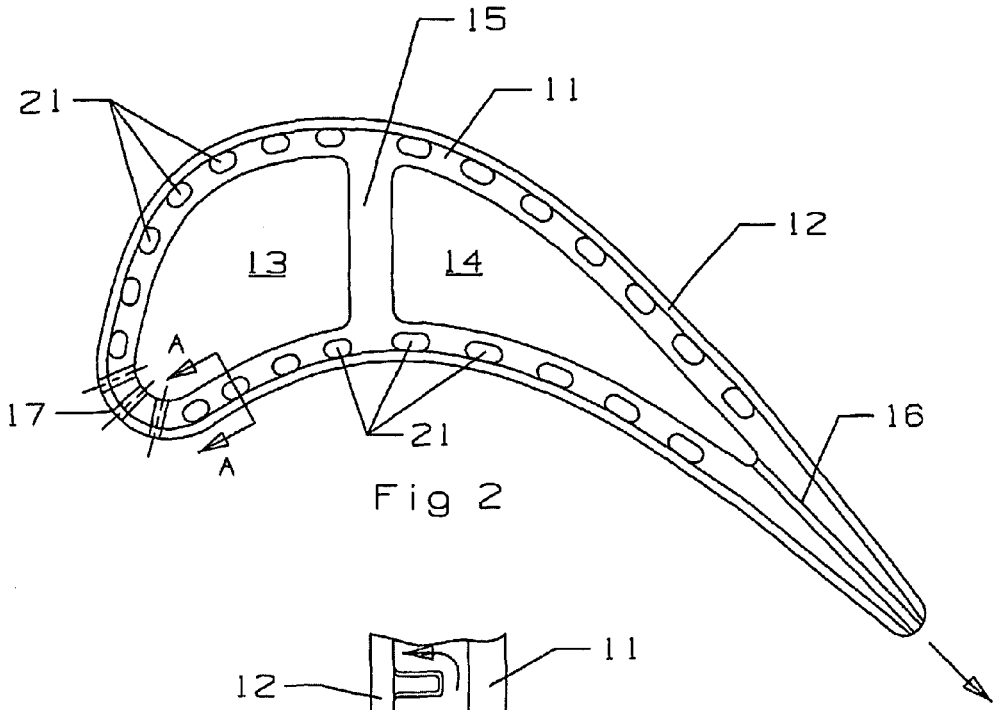
FIG. 2 shows a cross section view of the turbine airfoil near wall cooling passages of the present invention.

The present invention is a turbine airfoil for use in a gas turbine engine, such as an industrial gas turbine engine. The airfoil can be for a stator vane or a rotor blade. FIG. 2 shows a cross section view along the spanwise direction of the airfoil and include a spar 11 that forms a structural support for a thin thermal skin 12 that is bonded to the spar to form the outer airfoil surface of the blade or vane. The spar 11 includes a leading edge collector cavity 13 and a trailing edge collector cavity 14 separated by an internal rib 15. A row of exit holes 16 connects the trailing edge collector cavity 14 to the outside of the trailing edge of the airfoil. The leading edge collector cavity is connected to a showerhead arrangement of film cooling holes 17 to discharge a layer of film cooling air onto the outer airfoil surface of the leading edge region. The internal rib 15 is shown in FIG. 2 to be closer to the leading edge than to the trailing edge of the airfoil. However, the location of the internal rib 15 can be located at various positions between the two edges depending upon the size of the two collector cavities.

Figure 3:
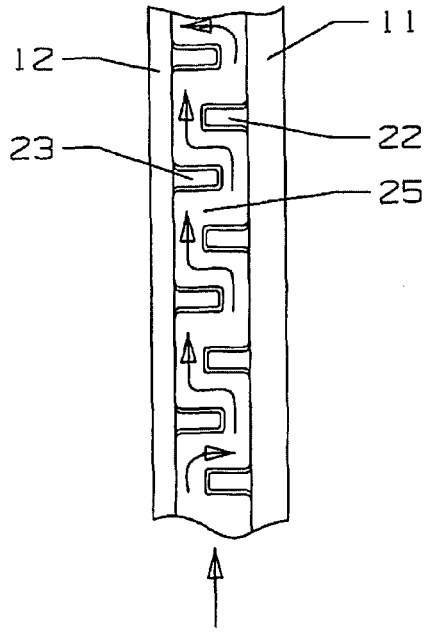
FIG. 3 shows a cross section side view of one of the mini serpentine flow near wall cooling passages in the present invention.

A number of radial extending mini serpentine flow channels 21 are formed between the spar 11 and the thin skin 12 and each form a serpentine flow passage along the airfoil in the spanwise direction. FIG. 3 shows a cross section side view of one of these mini serpentine flow passages. The spar 11 includes a number of mini pin fins 22 extending outward toward the thin skin 12. The thin skin 12 also includes a number of mini pin fins 23 extending inward from the thin skin and toward the spar 11. The pin fins on the spar and the thin skin form an alternating arrangement of pin fins that form the serpentine flow passage as seen in FIG. 3 that extends along the entire airfoil.

Figure 4:
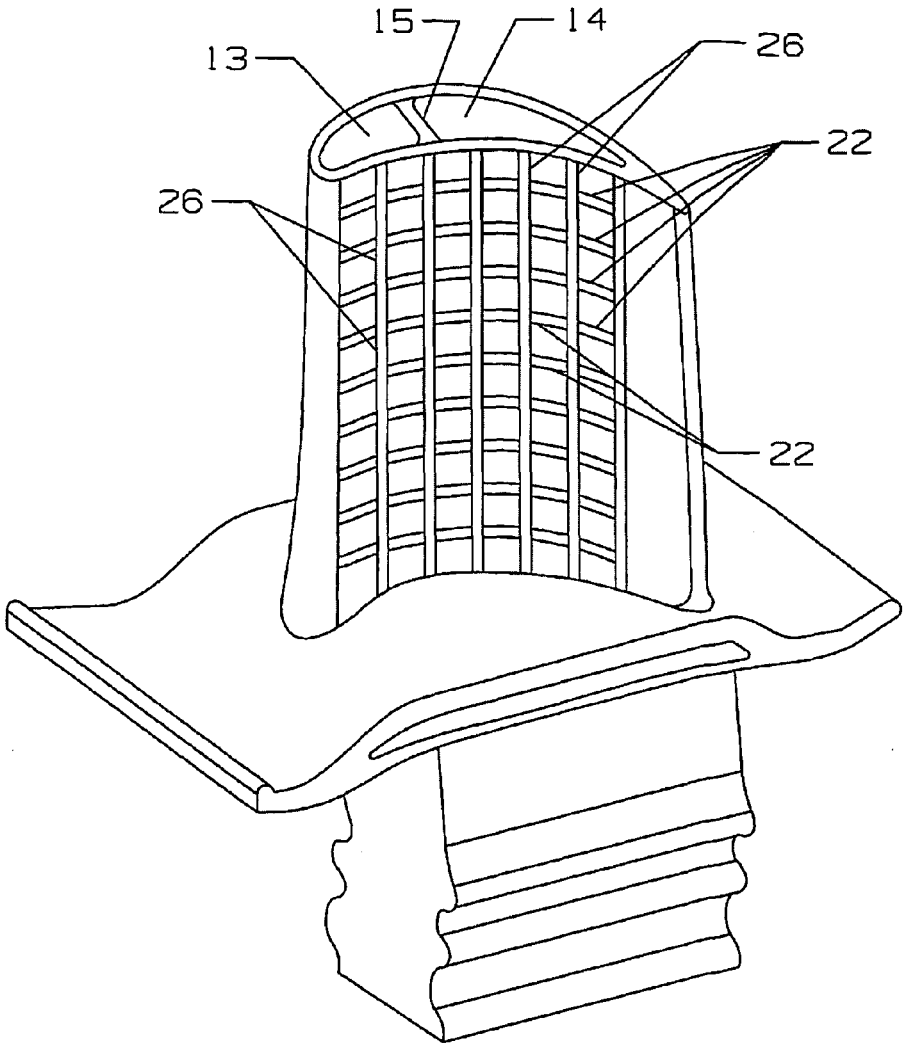
FIG. 4 shows a schematic view of a turbine blade with a cut-away view of the near wall mini serpentine flow passages along the pressure side wall of the present invention.

FIG. 4 shows a schematic view of a turbine blade with a cutaway view of a section on the pressure side wall in which a number of spanwise extending ribs 26 separate the mini serpentine passages that are formed by the alternating arrangement of pin fins 22 on the spar and the thin skin. The ribs 26 separate each of the mini serpentine flow passages.

The spar 11 with the mini pin fins 22 can be formed from a single piece using the investment casting process. Or, the spar can be cast and the mini pin fins machined into the outer surface. The thin skin 12 is formed with the mini pin fins on it as a single piece from any of the well known processes. With the thin skin having the mini pin fins bonded to the spar, the mini serpentine flow passages are formed that cannot be formed using the investment casting process. The mini pin fins 23 on the thin skin 12 can be formed by means of photo etching or chemical etching. The thickness of the thermal thin skin after etching can be in the range of 0.010 inches to 0.020 inches. The height of the mini pin fins extending from both the spar 12 and the thin skin 12 can be from about one half (½) the width of the serpentine passage formed between the thin skin and the spar, or about two thirds (⅔) of the serpentine passage width. After the thin skin 12 is bonded to the spar to form the airfoil, the leading edge film cooling holes 17 can then be drilled into the airfoil. The thin skin 12 can be bonded to the spar 11 using a transient liquid phase (TLP) bonding process. Also, the trailing edge exit cooling holes 16 can be drilled into the spar before or after the thin skin 12 is bonded to the spar 11. Also, one of the features of the present invention is that the thin skin 12 can be made of a different material (such as a high temperature resistant material) that the spar 11. Also, the thin skin 12 can be a single piece for the entire airfoil or made of several pieces.

A thin airfoil wall that allows for near wall cooling is considered to be an airfoil wall thick enough to prevent the airfoil wall from ballooning outward due to the internal pressure from the cooling air flow (internal cooling air pressure is greater than the external hot gas flow pressure) while being too thin to provide support for the airfoil wall by itself. A backing body such as the spar is required to provide for the rigid support to keep the airfoil from deforming during the hot gas flow around the airfoil. A thin skin wall allows for a high amount of heat transfer from the outer wall surface that is exposed to the hot gas flow and through the skin to the inner wall surface in which the cooling air makes contact. In a prior art cast blade or vane, the airfoil wall is so thick that the outer wall surface is much higher than the inner wall surface. In a ideal thin wall, the temperature of the outer wall surface would be close to the temperature of the inner wall surface on which the cooling air makes contact. However, if the thin skin is too thin in the present invention, the thin skin would deform under the pressure load from the hot gas flow.

In operation, pressurized cooling air is supplied to the blade through the root section and into the plurality of radial extending mini serpentine flow passages to provide near wall cooling for the airfoil wall. The cooling air flows through the mini serpentine passages and then into one of the two collector cavities 13 and 14. From the leading edge collector cavity 13, the spent cooling air is discharged through the film cooling holes 17 on the leading edge to provide a layer of film cooling air on the outer airfoil surface. From the trailing edge collector cavity 14, the spent cooling air flows out the row of exit holes 16 formed in the trailing edge to provide cooling for the trailing edge region of the airfoil.

Major design features and advantages of the mini serpentine flow passages in the airfoil of the present invention over the prior art cooling circuit are described below.

The mini serpentine flow cooling channel is formed by the over-lapping of multiple mini pin fins positioned in an alternating arrangement and perpendicular to the cooling flow path along the cooling flow channel. Cooling air flows axially perpendicular to the airfoil span. This is different from the traditional serpentine cooling rotor blade where the serpentine channel is perpendicular to the engine centerline and the cooling air flows in a radial inward and outward direction along the blade span.

For the mini serpentine flow channels, as the cooling air flows toward the blade external wall, it impinges onto the airfoil external wall and thus creates a very high rate of internal heat transfer coefficient. Also, as the cooling air turns in each mini serpentine flow channel, cooling air changes momentum which results in an increase of the heat transfer coefficient. The combination effects create a high cooling affect for the multiple turns within the cooling channels for a near wall airfoil cooling design.

For the airfoil mid-chord radial mini serpentine flow channel, the flow channel is oriented to induce cooling in the back and forth flow movement which is inline with the blade circumferential direction. Cooling air will impinge on to the airfoil pressure side and suction side inner surfaces and thus achieve a better cooling affect for the airfoil mid-chord section over the cited prior art airfoil.

The mini serpentine flow path can be designed to tailor the airfoil external heat load by means of varying the channel height as well as the cross sectional flow area at the middle of the turn path. A change in the pin fin spacing and/or pin fin height will thus impact the cooling flow mass flux which will alter the internal heat transfer coefficient and metal temperature along the flow path.

Due to the centrifugal pumping affect in a turbine blade as the blade rotates, the cooling air pressure increases within the serpentine flow channels in the direction toward the tip. This increase of cooling air working pressure can be used for the turn loss and friction loss in the wavy flow path formed by the serpentine flow passages between the alternating pin fins.

A double use of the cooling is achieved. The cooling air is used to cool the airfoil wall first, and then is discharged from the holes in the leading edge as film cooling air. This double use of the cooling air yields a very high over-all blade cooling effectiveness.

I claim the following:

1. A turbine airfoil comprising: a spar having a general airfoil shape with a leading edge and a trailing edge and a pressure side wall and a suction side wall extending between the two edges; the spar forming at least one collector cavity between the two walls; an outer surface of the spar includes a plurality of ribs extending in a spanwise direction along the airfoil; the outer surface of the spar includes a row of mini pin fins each extending between adjacent ribs; a thin thermal skin forming an outer airfoil surface bonded to the spar; the thin thermal skin having a plurality of mini pin fins extending out from the backside surface of the thin thermal skin; and, the mini pin fins on the spar and the thin thermal skin arranged in an alternating arrangement to form a serpentine flow passage between adjacent ribs; wherein the serpentine flow passages discharge into the collector cavity.

2. The turbine airfoil of claim 1, and further comprising: the thin thermal skin has a thickness of from 0.010 inches to 0.020 inches.

3. The turbine airfoil of claim 1, and further comprising: the thin thermal skin is made from material that has a higher resistance to temperature than the spar.

4. The turbine airfoil of claim 1, and further comprising: the spar includes an internal rib that forms a leading edge collector cavity and a trailing edge collector cavity;

a showerhead arrangement of film cooling holes connected to the leading edge collector cavity; and, a row of exit cooling holes connected to the trailing edge collector cavity and extending along the trailing edge region of the airfoil.

5. The turbine airfoil of claim 1, and further comprising:

the thin thermal skin is bonded to the spar by a transient liquid phase bonding process.

6. The turbine airfoil of claim 1, and further comprising:

a height of the mini pin fins extending from the thin thermal skin is in a range from one half to two thirds of the width of the serpentine flow passage.

7. The turbine airfoil of claim 1, and further comprising:

the thin thermal skin is formed from a single piece and extends around the spar to form the airfoil surface.

8. The turbine airfoil of claim 1, and further comprising:

the thin thermal skin is formed from a plurality of pieces and extends around the spar to form the airfoil surface.

9. The turbine airfoil of claim 4, and further comprising:

the serpentine flow passages in the leading edge section of the airfoil discharge into the leading edge cavity; and, the serpentine flow passages in the trailing edge section of the airfoil discharge into the trailing edge cavity.

10. The turbine airfoil of claim 1, and further comprising:

the external ribs formed on the spar are parallel to each other and extend from the trailing edge region on the pressure side, around the leading edge and along the suction side to the trailing edge region of the airfoil.

11. The turbine airfoil of claim 1, and further comprising:

the spar and the external ribs and the mini pin fins are formed as a single piece.

* * * * *